United States Patent [19]

Nishigaki et al.

[11] 4,316,948

[45] Feb. 23, 1982

[54] PHOTOCONDUCTIVE CDS POWDER MATERIAL FOR ELECTROPHOTOGRAPHY

[75] Inventors: Yuji Nishigaki, Yokohama; Masanao Kasai, Tokyo; Kazumi Okano, Fuchu, all of Japan

[73] Assignee: Canon Kabushiki Kaisha, Tokyo, Japan

[21] Appl. No.: 186,582

[22] Filed: Sep. 12, 1980

[30] Foreign Application Priority Data

Sep. 19, 1979 [JP] Japan ..... 54-121288

[51] Int. Cl.[3] ..... G03G 5/087

[52] U.S. Cl. ..... 430/94; 430/135; 430/67; 427/217; 252/501.1

[58] Field of Search ..... 430/94, 135; 252/501; 427/217

[56] References Cited

FOREIGN PATENT DOCUMENTS 50-32945 3/1975 Japan ..... 430/94

*Primary Examiner*—John D. Welsh

*Attorney, Agent, or Firm*—Fitzpatrick, Cella, Harper & Scinto

[57] ABSTRACT

A photoconductive material for electrophotography is composed of photoconductive cadmium sulfide particles provided with a hydroxide, oxide or sulfide of a metal element or semiconductive element on the particle surface. The photoconductive material dispersed in a binder resin can be used as a photoconductive layer for an electrophotographic photosensitive member.

12 Claims, 2 Drawing Figures

PHOTOCONDUCTIVE CDS POWDER MATERIAL FOR ELECTROPHOTOGRAPHY

BACKGROUND OF THE INVENTION

1. Field of the Invention

This invention relates to photoconductive materials for electrophotography, and more particularly, to photoconductive materials of high humidity resistance and having desirable electric charge transfer characteristics.

2. Description of the Prior Art

Electrophotographic photosensitive members may assume a variety of constructions depending upon the types of electophotographic processes. As a representative electrophotographic photosensitive member, there may be mentioned a photosensitive member composed of a substrate and a photoconductive layer and a photosensitive member having an insulating layer on the surface. These are widely used.

The photosensitive member composed of a substrate and a photoconductive layer is used for the most common electrophotographic process, that is, a process comprising charging, imagewise exposure, development and if desired, transfer of developed images.

An insulating layer of a photosensitive member having an insulating layer serves to protect the photoconductive layer, improve mechanical strength and dark decay characteristics, and make the photosensitive member suitable for a particular electrophotographic process or further produce a photosensitive member free from pollution.

Representative examples of such photosensitive member having an insulating layer or an electrophotographic process employing such photosensitive member are disclosed in U.S. Pat. No. 2,860,048, Japanese Patent Publication No. 16429/1966, U.S. Pat. Nos. 3,146,145, 3,607,258, 3,666,363, 3,734,609, 3,457,070 and 3,124,456 and the like.

Electrophotographic photoconductive materials are naturally required to have a particular sensitivity and optical characteristics suitable for the electrophotographic process and an improved humidity resistance. Further, in case of an electrophotographic process which comprises a step of injecting electric charges from the substrate side into between the photoconductive layer and the insulating layer upon charging, characteristics affecting lasiness of electric charge transfer in the photoconductive layer should be adjusted.

SUMMARY OF THE INVENTION

An object of the present invention is to provide cadmium sulfide used as a photoconductive material of an improved humidity resistance and desired electric charge transfer characteristics.

According to one aspect of the present invention, there is provided a photoconductive material for electrophotography which comprises photoconductive cadmium sulfide particles the surface of which a compound selected from the group consisting of hydroxides, oxides and sulfides of metal elements and semiconductive elements is attached to.

According to another aspect of the present invention, there is provided an electrophotographic photosensitive member which comprises a photoconductive layer comprising photoconductive cadmium sulfide particles the surface of which a compound selected from the group consisting of hydroxides, oxides and sulfides of metal elements and semiconductive elements is attached to and a binder resin in which the photoconductive cadmium sulfide particles are dispersed.

DESCRIPTION OF THE PREFERRED EMBODIMENTS

Figure 1:
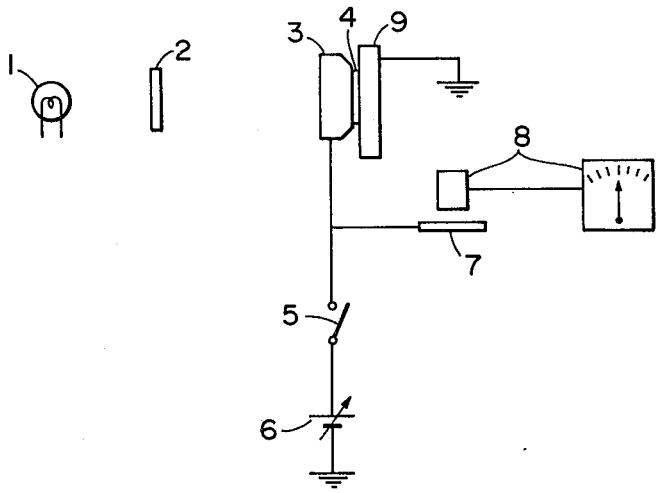
FIG. 1 shows schematically a device for measuring electric charge transfer characteristics of a photosensitive member.

According to the present invention, a photoconductive material for electrophotography with improved humidity resistance and controlled electric charge transfer characteristics can be obtained by attaching a compound selected from the group consisting of hydroxides, oxides, and sulfides of metal elements and semiconductive elements (hereinafter called "hydroxides and others") to the surface of cadmium sulfide particles.

Further, there can be obtained a photoconductive material free from fatigue phenomenon upon applying repeatedly an electrophotographic process by attaching hydroxides and others to the surface of cadmium sulfide particles.

In particular, the photoconductive material according to the present invention can be effectively used in a high speed electrophotographic copying process where prior to charging, a preliminary exposure is effected so as to erase the remaining electrostatic images produced by the previous cycle of process As the metal elements, there may be mentioned Cd, In, Al, Ag, Zn, Cu and the like.

As the hydroxides of the metal elements, there may be mentioned $Cd(OH)_2$, $In(OH)_3$, $Al(OH)_3$, $Zn(OH)_2$, $Cu(OH)_2$ and the like.

As the oxides of the metal elements, there may be mentioned $Ag_2O$, $Al_2O_3.SiO_2$, $Al_2O_3$ and the like.

As the sulfides of the metal elements, there may be mentioned CdS, $Ag_2S$, ZnS, $In_2S_3$ and the like.

As the semiconductive elements, there may be mentioned Si, Ge and the like.

As the compounds of the semiconductive elements there may be mentioned $GeO_2$, $SiO_2$ and the like.

The amount of hydroxides and others attached to the cadmium sulfide particles is preferably such that the thin film formed as the result of attaching the hydroxides and others to the cadmium sulfide particles is preferably not more than 1000 Å, in particular, 200–10 Å in thickness. It is not necessary that the thin film completely and uniformly covers the whole surface of the particle, but the thin film may be attached to the surface in such a form as islands.

Therefore, the above-mentioned thickness of the thin film in an average value assuming that the whole surface of the particle is covered.

Attaching the hydroxides and others to the CdS particles may be conducted by vapor deposition, wet or dry type plating and the like. In particular, attaching by utilizing chemical reactions is preferable.

As typical constructions of photosensitive members prepared with the photoconductive materials according to the present invention, there are a construction comprising a substrate and a photoconductive layer, and another construction comprising an insulating layer on the photoconductive layer. The photosensitive member is most usually formed by forming the photoconductive layer on the substrate, or by further forming the insulating layer on the photoconductive layer if necessary. As an electroconductive substrate, there may be mentioned metals such as stainless steel, Al, Cr, Mo, Au, In, Nb, Ta, V, Ti, Pt, Pd and the like, and alloys thereof. In case of using an insulating substrate, if necessary, the surface is conductivized, for example, the surface of glass is conductivized with $In_2O_3$, $SnO_2$ and the like. When synthetic resin film such as a polyimide film and the like is used, the surface thereof is conductivized by vacuum deposition, electron-beam deposition, sputtering, and the like with metals such as Al, Ag, Pb, Zn, Ni, Au, Cr, Mo, Ir, Nb, Ta, V, Pi, Pt and the like, or by laminating with the above-mentioned metals.

A photoconductive layer is usually formed by a photoconductive material dispersed and included in a binder. Usual various insulating resins are suitably used for binder for forming the photoconductive layer. For example, there may be mentioned polyethylene, polyester, polypropylene, polystyrene, polyvinyl chloride, polyvinyl acetate, acrylic resins, polycarbonate, silicone resins, fluororesins, epoxy resins, and the like.

A content of the binder used for forming the photoconductive layer is an amount of 0.5~50 parts by weight, preferably 5~20 parts by weight, per 100 parts by weight of CdS.

The thickness of the photoconductive layer varies depending upon a type or properties of a used photoconductive layer. It is usually 5~100 microns, especially preferably above 10~50 microns.

In a photosensitive member comprising an insulating layer, conventional various resins may be suitably used as a resin for forming the insulating layer. For examples, there may be mentioned polyethylene, polyester, polypropylene, polystyrene, polyvinyl chloride, polyvinyl acetate, acrylic resins, polycarbonate, silicone resins, fluororesins, epoxy resins, and the like. The thickness of the insulating layer is usually 0,1~100 microns, preferably 0.1~50 microns.

In an electrophotographic process utilizing transfer of electric charges to the interface between an insulating layer and a photoconductive layer by injecting electric charges from the substrate upon charging, it is necessary for forming images of good contrast that a sufficient amount of electric charges is transferred. For sufficient transfer of electric charges, it is desired that the photoconductive layer is of lower electric resistance. This state of lower electric resistance is a state which is immediately after the photoconductive layer is irradiated and before the electric resistance has returned to the high electric resistance as that before the irradiation.

The time interval between the irradiation step such as preliminary exposure and the like and the charging step in electrophotographic processes varies depending upon the process conditions such as copying speed and the like.

According to the present invention, as shown in the working examples (infra), photosensitive members having a variety of the recovering times can be easily produced, and therefore, a photosensitive member suitable for a desired electro-photographic process can be easily obtained.

Representative examples of the above mentioned electrophotographic process are shown in U.S. Pat. Nos. 3,666,363 and 3,734,609 and the like where electrostatic images are produced by primary charging, secondary charging with a polarity opposite to the primary charging or AC discharging simultaneously with imagewise exposure, and a blanket exposure (this may be omitted). Further, the examples are shown in U.S. Pat. No. 3,457,070, Japanese Patent Publication Nos. 13437/1969 and 44902/1974 where the imagewise exposure is effected before or after the secondary charging or AC discharging. Still further example is disclosed in U.S. Pat. No. 3,041,167.

COMPARATIVE EXAMPLE 1

There were prepared CdS particles having an average particle size of 4 microns which contained $12\times10^{-4}$ mole of copper as an activator (impurity) per 1 mole of CdS. The CdS thus prepared was mixed witha vinyl chloride-vinyl acetate copolymer (tradename, VMCH, supplied by Union Carbide Co.). The amount of the copolymer (binder) was 12% by weight based on CdS.

The resulting mixture was coated in the thickness of about 40 microns on an aluminum foil (50 microns thick) by knife-coating to form a photoconductive layer and dried. As an insulating layer, transparent film (polyethylene terephthalate) of 25 microns thick provided with an adhesive layer of 8 microns thick was adhered to the photoconductive layer to produce a three-layered electrophotographic photosensitive member.

Then the photoresponse and photodecay were measured.

The measurement was carried out by the device illustrated in FIG. 1.

A glass plate 3 having a transparent electrode 4 was pressed to the surface of an insulating layer of a photosensitive member 9. Transparent electrode 4 was connected to a high voltage DC power source 6 through a relay switch 5.

A shutter was opened to irradiate the photosensitive member with white light from a halogen lamp 1 so as to conduct preliminary exposure for 0.2 sec. and after a period of time (T), relay switch 5 was closed to apply a high voltage (Va) for 0.2 sec., and then was opened for 0.2 sec. followed by the irradiation for 0.2 sec. again. The change of voltage (Vp) was measured by means of a surface potentiometer 8 and a metal plate 7 of the same voltage as the photosensitive member.

Figure 2:
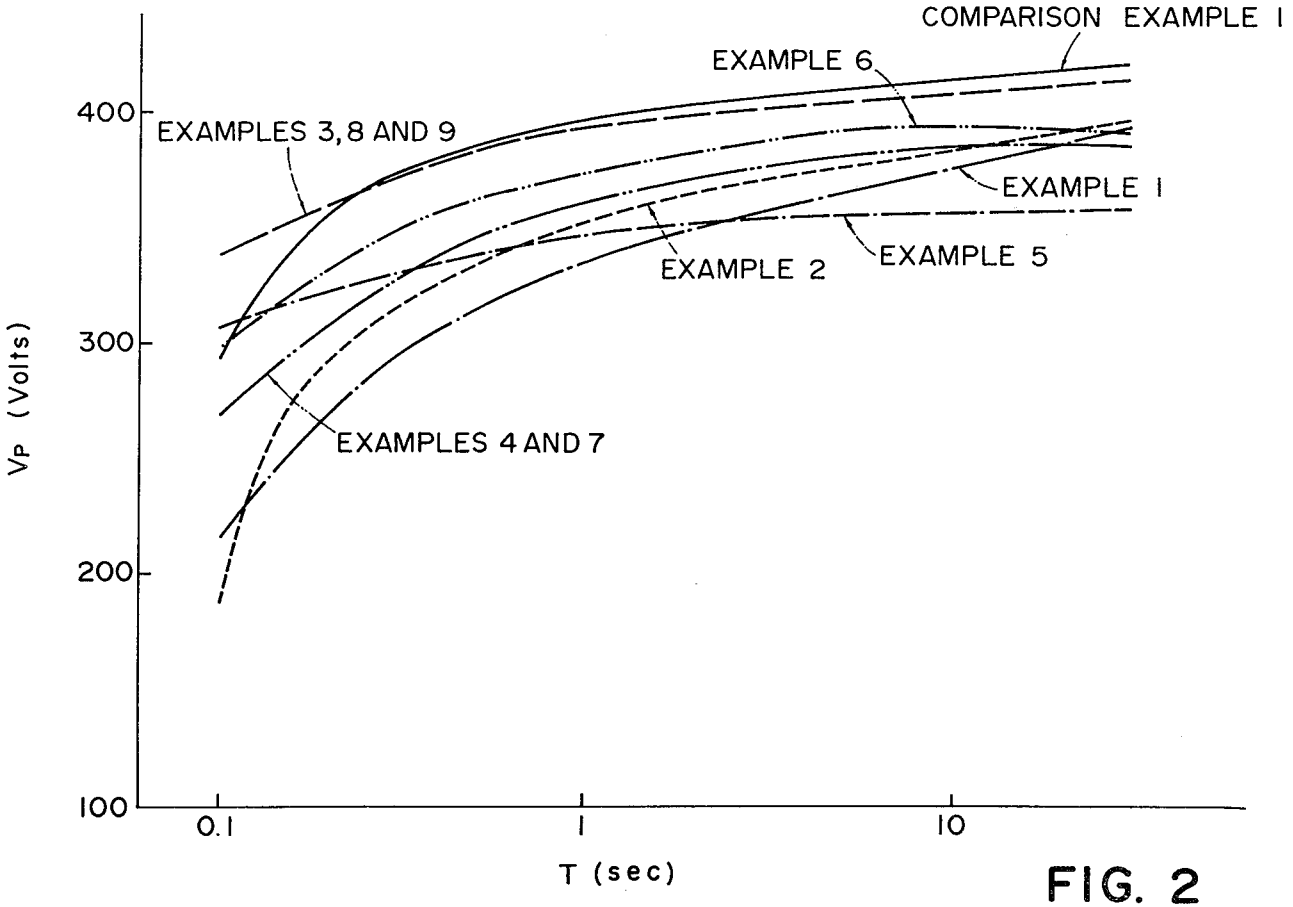
FIG. 2 is a graph showing voltages applied to a photoconductive layer of a photosensitive member where the photoconductive material according to the present invention is employed.

Change of $|Vp|$ was as shown in FIG. 2 when Va was +1000 volts, illumination intensity of the halogen lamp was about 200 lux and T was 0.1–30 sec. "Vp" is a voltage applied to the photoconductive layer. Therefore, the less the Vp, the smoother the transfer of electric charge to the boundary between the insulating layer and the photoconductive layer.

In addition, this indicates that the larger the difference between Vp value at a small T value and Vp value at a large T value, the larger the decay of exposure effect of the preliminary exposure.

COMPARATIVE EXAMPLE 2

After the photosensitive member described in Comparative example 1 was soaked in deionized water for about 10 hrs. the member was mounted on the device shown in FIG. 1. Then high voltage DC power source 6 was converted into AC source to effect forced deterioration. An applied voltage of 50 Hz, and 1.3 KV rms applied for about 3 minutes and 30 seconds. Subsequently, voltage 6 was again converted into the DC source to carry out the determination similar to that described in Comparative example 1. However, the applied voltage was −2000 Volt. As a result, |Vp| was equal to 330 Volt, when T was 3 seconds. On the other hand, without soaking in water and carrying out forced deterioration, |Vp| was equal to 1020 Volt. Consequently, it was confirmed that the photosensitive member deteriorated under high humidity (high moisture content).

EXAMPLE 1

In a 300 ml beaker was placed 30 g of photoconductive CdS powder (that described in the same CdS powder was also used in the following examples), and 0.077 g ($3\times10^{-4}$ mol) of $CdSO_4.8/3H_2O$ dissolved in 100 ml of water was added and stirred for 5 minutes by a magnetic stirrer. 50 ml of a solution containing $6\times10^{-4}$ mol of NaOH was added dropwise with stirring to the beaker, while pH of the solution is maintained within 7~9 over the above-mentioned period of time. The resulting mixture was additionally stirred for 10 minutes, stood for 10 minutes, decanted, washed with deionized water 3 times, and filtrated under pressure. The resulting precipitate was dried at 60° C. for 20 hours to yield CdS powder having $Cd(OH)_2$ deposited on the surface thereof.

A photosensitive plate having the same form as that described in Comparative example 1 was prepared by the above-mentioned CdS, then a determination similar to that described in Comparative example 1 was carried out (FIG. 2). As shown in FIG. 2, photoresponse increased, and photodecay became rather great.

Further, the determination described in Comparative example 2 was carried out by the above-mentioned photosensitive plate to obtain the result that |Vp| was equal to 930 V before deterioration and to 410 V after deterioration. In short, deterioration was reduced.

EXAMPLE 2

| | |
|---|---|
| Photoconductive CdS powder | 30g |
| $In_2(SO_4)_3 . 9H_2O$ | 0.2g($3\times10^{-4}$mol) |
| Aqueous ammonia | $2\times10^{-3}$mol |

With the above recipe, CdS powder having $Cd(OH)_2$ deposited on the surface thereof was obtained by the similar procedure to that described in Example 1. As shown in FIG. 2, a photosensitive plate prepared with the resulting CdS powder showed increase in photoresponse and greater photodecay than that in Example.

|Vp| was equal to 1020 V before deterioration and to 440 V after deterioration. In short, deterioration was reduced.

EXAMPLE 3

| | |
|---|---|
| Photoconductive CdS powder | 30g |
| $Al(NO_3)_3 . 9H_2O$ | 0.56g($1.5\times10^{-3}$mol) |
| Aqueous ammonia | $5\times10^{-3}$mol |

With the above recipe, CdS powder having $Al(OH)_3$ deposited on the surface thereof was obtained by the similar procedure to that described in Example 1.

As shown in FIG. 2, a photosensitive plate prepared with the resulting CdS powder showed decrease in both photoresponse and photodecay.

|Vp| was equal to 960 V before deterioration and to 400 V after deterioration. In short, deterioration was reduced.

EXAMPLE 4

In a 300 ml beaker was placed 30 g, of photoconductive CdS powder, and then 0.077 g ($3\times10^{-4}$ mol) of $CdSO_4.8/3H_2O$ dissolved in 100 ml of water was added thereto and stirred for 5 minutes by a magnetic stirrer. An aqueous solution (50 ml) of $3\times10^{-4}$ mol of $Na_2S$ was added dropwise to the beaker. The resulting mixture was additionally stirred for 10 minutes, stood for 10 minutes, decanted, washed with deionized water 3 times, and filtrated under pressure. The resulting precipitate was dried at 60° C. for 20 hours to yield CdS powder having CdS deposited on the surface thereof. As shown in FIG. 2, a photosensitive plate prepared with the resulting CdS had great photoresponse and photodecay which is almost equal to that of comparative example 1.

EXAMPLE 5

| | |
|---|---|
| Photoconductive CdS powder | 30g |
| $AgNO_3$ | 0.1g($6\times10^{-4}$mol) |
| $Na_2S$ | $3\times10^{-4}$mol |

With the above recipe, CdS powder having $Ag_2S$ deposited on the surface thereof was prepared by the similar procedure to that described in Example 4. As shown in FIG. 2, a photosensitive member prepared with the resulting CdS powder had small photoresponse.

EXAMPLE 6

| | |
|---|---|
| Photoconductive CdS powder | 30g |
| $ZnCl_2$ | 0.04g($3\times10^{-4}$mol) |
| $Na_2S$ | $3\times10^{-4}$mol |

With the above recipe, CdS powder having ZnS deposited on the surface thereof was obtained by the similar procedure to the described in Example 4. As shown in FIG. 2, photoresponse reduced in a photosensitive member prepared with the resulting CdS.

EXAMPLE 7

| | |
|---|---|
| Photoconductive CdS powder | 30g |
| $In_2(SO_4)_3 . 9H_2O$ | 0.4g($6\times10^{-4}$mol) |
| $Na_2S$ | $2\times10^{-3}$mol |

With the above recipe, CdS powder having $In_2S_3$ deposited on the surface thereof was obtained by the similar procedure to that described in Example 4. A photosensitive member prepared with the resulting CdS powder showed similar photoresponse to that described in Example 4.

EXAMPLE 8

In a 300 ml beaker were placed 50 g of photoconductive CdS powder and 1.1 g ($5\times10^{-3}$ mol) of sodium silicate ($Na_2Si_2O_5.XH_2O$) dissolved in 150 ml of water, and pH of the mixture was maintained between 6 and 8 by addition of HCL. The mixture was kept as 85°-95° C. by a mantle heater under stirring for 30 minutes. Then the mixture was decanted, washed with deionized water, and filtrated under pressure. The resulting precipitate was dried at 60° C. for 20 hours to yield CdS powder having silica ($SiO_2.XH_2O$) deposited on the surface thereof. A photosensitive member prepared with the resulting CdS had similar properties to that described in Example 3.

EXAMPLE 9

In a 300 ml of beaker were placed 50 g of photoconductive CdS powder and 0.11 g ($5\times10^{-4}$ mol) of sodium silicate ($Na_2Si_2O_5.XH_2O$) dissolved in 150 ml of water. The mixture was stirred by a magnetic stirrer for 5 minutes. 0.38 g ($10^{-5}$ mol) of $Al(NO_3)_3.9H_2O$ was dissolved in 50 ml of water, and added to the beaker with stirring. The resulting mixture was additionally stirred for 10 minutes, stood for 10 minutes, decanted, washed with deionized water 3 times, and filtered under pressure. The resulting precipitate was dried at 60° C. for 20 hours to yield CdS powder having alumina silica ($Al_2O_3.SiO_2.XH_2O$) deposited on the surface thereof. A photosensitive member prepared with the resulting CdS had similar properties to that described in Example 3.

What we claim is:

1. A photoconductive material for electrophotography which comprises photoconductive cadmium sulfide particles to the surface of which is attached an inorganic compound selected from the group consisting of metallic and semiconductive hydroxides, oxides and sulfides.

2. A photoconductive material for electrophotography according to claim 1 in which the metal is Cd, In, Al, Ag, Zn or Cu and the semiconductor is Si or Ge.

3. An electrophotographic photosensitive member which comprises a photoconductive layer comprising photoconductive cadmium sulfide particles, to the surface of which is attached an inorganic compound selected from the group consisting of metallic and semiconductor hydroxides, oxides and sulfides, and a binder resin in which the photoconductive cadmium sulfide particles are dispersed.

4. An electrophotographic photosensitive member according to claim 3 in which, an insulating layer is disposed on the photoconductive layer.

5. A photoconductive material for electrophotography according to claim 1 in which said inorganic compound is a hydroxide, oxide or sulfide of a metal selected from the group consisting of Cd, In, Al, Ag, Zn and Cu or is a hydroxide, oxide or sulfide of a semiconductor selected from the group consisting of Si and Ge.

6. An electrophotographic photosensitive member according to claim 3 in which said inorganic compound is a hydroxide, oxide or sulfide of a metal selected from the group consisting of Cd, In, Al, Ag, Zn and Cu or is a hydroxide, oxide or sulfide of a semiconductor selected from the group consisting of Si and Ge.

7. A photoconductive material for electrophotography according to claim 1 wherein the surface of said cadmium sulfide particles has a chemically-deposited thin film of said inorganic compound thereon.

8. A photoconductive material for electrophotography according to claim 7 in which the thickness of said thin film is not more than 1000 Å.

9. A photoconductive material for electrophotography according to claim 7 in which the thickness of said thin film is from 10 to 200 Å.

10. An electrophotographic photosensitive member according to claim 3, wherein the surface of said cadmium sulfide particles has a chemically-deposited thin film of said inorganic compound thereon.

11. An electrophotographic photosensitive member according to claim 10, wherein the thickness of said thin film is not more than 1000 Å.

12. An electrophotographic photosensitive member according to claim 10, in which the thickness of said thin film is from 10 to 200 Å.

* * * * *